US007096607B2

(12) United States Patent
Guzman

(10) Patent No.: US 7,096,607 B2
(45) Date of Patent: Aug. 29, 2006

(54) CLOTHING WITH EXTERNALLY ACTIVATED SWITCH

(75) Inventor: Rudy Guzman, Coral Springs, FL (US)

(73) Assignee: BBC International, Ltd., Boca Raton, FL (US)

( * ) Notice: Subject to any disclaimer, the term of this patent is extended or adjusted under 35 U.S.C. 154(b) by 212 days.

(21) Appl. No.: 10/753,679

(22) Filed: Jan. 8, 2004

(65) Prior Publication Data

US 2005/0150138 A1 Jul. 14, 2005

(51) Int. Cl.
*A43B 23/00* (2006.01)

(52) U.S. Cl. ..... 36/137; 36/139; 36/136

(58) Field of Classification Search ..... 36/136, 36/137, 139; 362/103
See application file for complete search history.

(56) References Cited

U.S. PATENT DOCUMENTS

| | | | | | |
|---|---|---|---|---|---|
| 2,940,184 | A | | 6/1960 | Malone | 36/1 |
| 4,043,241 | A | | 8/1977 | Liu | 84/1.01 |
| 4,350,853 | A | | 9/1982 | Ganyard | 200/52 R |
| 4,646,350 | A | * | 2/1987 | Batra | 704/272 |
| 4,771,556 | A | | 9/1988 | Kim | 36/139 |
| 4,848,009 | A | * | 7/1989 | Rodgers | 36/137 |
| 5,159,768 | A | | 11/1992 | Longo, Jr. | 36/139 |
| 5,343,190 | A | * | 8/1994 | Rodgers | 340/573.1 |
| 5,345,700 | A | | 9/1994 | Norment | 36/139 |
| 5,381,615 | A | | 1/1995 | MacMillan | 36/137 |
| 5,402,590 | A | | 4/1995 | Lee | 36/139 |
| 5,422,628 | A | * | 6/1995 | Rodgers | 340/573.1 |
| 5,483,759 | A | | 1/1996 | Silverman | 36/137 |
| 5,530,626 | A | | 6/1996 | Norment | 361/814 |
| 5,649,376 | A | | 7/1997 | Lecates, Jr. | 36/137 |
| 5,714,706 | A | | 2/1998 | Nakada et al. | 84/730 |
| 5,765,300 | A | | 6/1998 | Kianka | 36/139 |
| 5,812,063 | A | | 9/1998 | Weng et al. | 340/815.45 |
| 5,813,148 | A | | 9/1998 | Guerra | 36/137 |
| 5,855,080 | A | | 1/1999 | Van Staden | 36/139 |
| 5,860,727 | A | | 1/1999 | Chien | 362/84 |
| 5,894,201 | A | | 4/1999 | Wong | 315/241 S |
| 5,909,088 | A | | 6/1999 | Wut | 315/200 A |
| 5,969,479 | A | | 10/1999 | Wong | 315/200 A |
| 6,000,149 | A | | 12/1999 | Pomerantz | 36/139 |
| 6,002,091 | A | * | 12/1999 | Reneau | 200/61.45 M |
| 6,012,822 | A | | 1/2000 | Robinson | 362/103 |
| 6,030,106 | A | | 2/2000 | Johnson | 362/500 |
| 6,053,622 | A | | 4/2000 | Horowitz et al. | 362/276 |
| 6,238,056 | B1 | | 5/2001 | Ripasarda | 362/103 |
| 6,286,975 | B1 | | 9/2001 | Rodgers | 362/103 |
| 6,315,571 | B1 | | 11/2001 | Lee | 434/250 |
| 6,525,487 | B1 | | 2/2003 | Wei | 315/200 A |
| 2002/0047646 | A1 | | 4/2002 | Lys et al. | 315/312 |
| 2002/0048169 | A1 | | 4/2002 | Dowling et al. | 362/234 |
| 2002/0070666 | A1 | | 6/2002 | Dowling et al. | 315/312 |
| 2003/0011325 | A1 | | 1/2003 | Pi | 315/291 |
| 2003/0137258 | A1 | | 7/2003 | Piepgras et al. | 315/291 |

FOREIGN PATENT DOCUMENTS

DE 203 17 143 U1 4/2004

* cited by examiner

*Primary Examiner*—Marie Patterson
(74) *Attorney, Agent, or Firm*—GrayRobinson, PA

(57) ABSTRACT

An article of clothing includes an electrical circuit having a battery, one or more integrated circuits connected to a signal device such as an array of LEDs and/or a loudspeaker, and, at least one switch which is operative to activate the integrated circuit(s) in response to the application of a magnetic field to the switch from a permanent magnet located externally of the article of clothing.

10 Claims, 3 Drawing Sheets

CLOTHING WITH EXTERNALLY ACTIVATED SWITCH

FIELD OF THE INVENTION

This invention relates to articles of clothing, and, more particularly, to a shoe having an array of light sources such as LEDs and a loudspeaker which are activated by a magnetic field brought into proximity with the shoe from an external source.

BACKGROUND OF THE INVENTION

For a number of years, articles of footwear and various items of clothing have been sold with decorative arrays of light sources such as light emitting diodes (LEDs) and/or a loudspeaker capable of producing a sound. This has been particularly popular in children's shoes where the LEDs are arranged to complement other design elements of the shoe such as cartoon characters and the like.

In a typical design of a children's shoe of the type noted above, a module including a plastic housing is placed in a cavity usually formed in the heel area of the shoe. The module mounts a battery, a switch and conventionally an integrated circuit which is connected by wires to LEDs positioned along the outsole, upper or tongue of the shoe. The integrated circuit may also be capable of generating a signal which operates a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

The integrated circuits employed in modules for children's shoes and other applications are activated by the switch associated with the module. In most designs, the switch is not operated manually but turns on and off in response to the application of an inertial force, pressure or motion. Spring switches such as shown in U.S. Pat. Nos. RE37,220 and 5,909,088 are a popular choice for children's shoes because they are reliable, noiseless and movable from a neutral or off position to a closed or on position in response to walking, running or other motion of the shoe. Pressure switches such as shown in U.S. Pat. Nos. 5,159,768; 5,649,376; 5,855,080 and 5,714,706 are also employed and they operate in response to the application of a weight, e.g. when the child steps onto a surface.

Another type of switch employed in children's shoes and similar applications is a magnetically activated switch such as shown in U.S. Pat. Nos. 5,422,628 and 5,343,190. In these designs, a reed switch and a permanent magnet are mounted within the heel or other area of the shoe. The magnet is movable between a first position where it is spaced from the reed switch and a second position close to the reed switch. A spring normally biases the magnet to the first position, but when motion or an inertial force is applied to the shoe, the magnet overcomes the spring force and moves to the second position where its magnetic field causes the reed switch to close.

SUMMARY OF THE INVENTION

This invention is directed to an article of footwear, and a module mounted to the article of footwear having an electrical circuit including a battery, one or more integrated circuits connected to a signal device such as an array of LEDs and/or a loudspeaker, and, at least one switch which is operative to activate the integrated circuits in response to the application of a magnetic field from a permanent magnet located externally of the article of footwear.

In the presently preferred embodiment, the module includes a plastic housing which mounts the battery, a lighting integrated circuit connected by wires to a number of LEDs and a sound integrated circuit connected to one or more loudspeakers. A spring switch is connected between the battery and the lighting integrated circuit which turns on and off in response to the application of motion or an inertial force to the article of footwear or shoe e.g. by walking, running or other motion. Operation of the spring switch activates the lighting integrated circuit which is effective to cause the LEDs to illuminate, preferably in a flashing or other lighting sequence for a predetermined period of time.

A second switch, preferably a reed switch, is mounted to the module or within a separate casing in the shoe. The reed switch is formed with cooperating contacts which are movable relative to one another under the influence of a magnetic field from a separated or open position to a closed position where they engage one another. In order to move the contacts of the reed switch to the closed position, a magnetic field is applied in proximity to the shoe, preferably by a permanent magnet. In one embodiment, closure of the reed switch causes a circuit connection to be made wherein both the sound integrated circuit and the light integrated circuit are activated, thus causing both the LEDs and the loudspeaker to operate at the same time. Alternatively, closing of the reed switch activates only the loudspeaker.

The application of a magnetic field externally of a shoe to activate the loudspeaker, and in one embodiment both the loudspeaker and LEDs, adds an element of fun and excitement to the shoe of this invention, particularly for young children. A permanent magnet capable of closing the reed switch may be housed in a wand or other toy item which the child "waves" over the shoe in the area of the reed switch to close it. The sound integrated circuit can be programmed to produce different sounds corresponding to the type of toy item which houses the permanent magnet, adding to the fun and enjoyment of the children wearing the shoes and playing with them.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
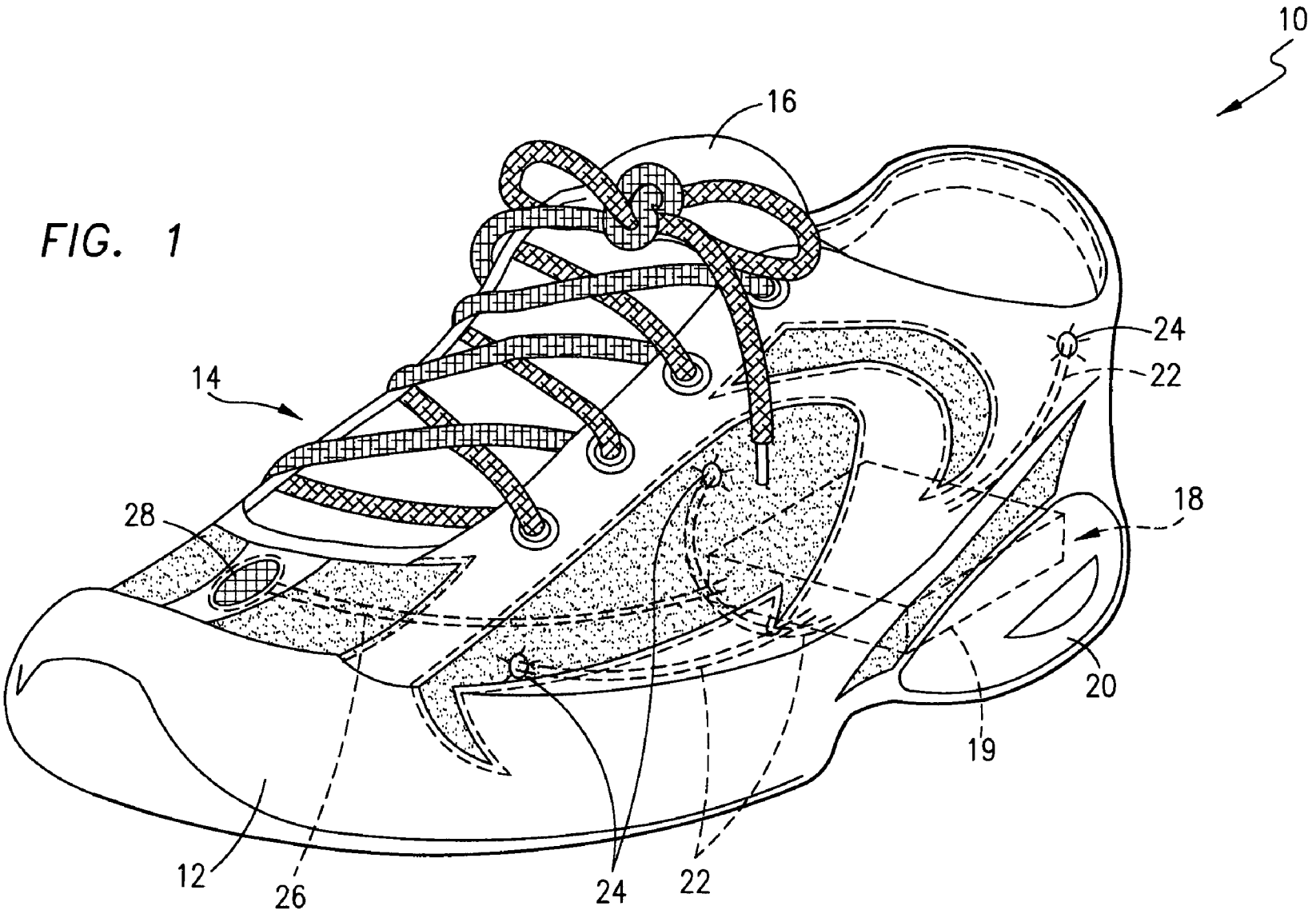
FIG. 1 is a perspective view of a shoe containing a module which is connected to an array of LEDs and to a loudspeaker both mounted to the upper of the shoe.

Referring now to the drawings, a shoe 10 is shown in FIG. 1 having an outsole 12 connected to an upper 14 including a tongue 16. It should be understood that essentially any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

A module 18 having a housing 19 preferably made of plastic is mounted in the heel 20 of the shoe 10. A cavity (not shown) is hollowed out of the heel 20 to receive the module 18, over which the sock liner or insole of the shoe 10 is secured. As schematically illustrated in FIG. 1, the module 18 is connected by wires 22 to an array of LEDs 24 mounted to the upper 14 of the shoe 10, and by a wire 26 to a loudspeaker 28 also carried by the upper 14. The particular location or arrangement of the LEDs 24 on the shoe 10 is a matter of choice, and it is contemplated they could be placed on the outsole 12, tongue 16 and in essentially any other position on the shoe 10. The loudspeaker 28 is preferably mounted to the tongue 16 or some area of the upper 14, rather than on the outsole 12.

Figure 2:
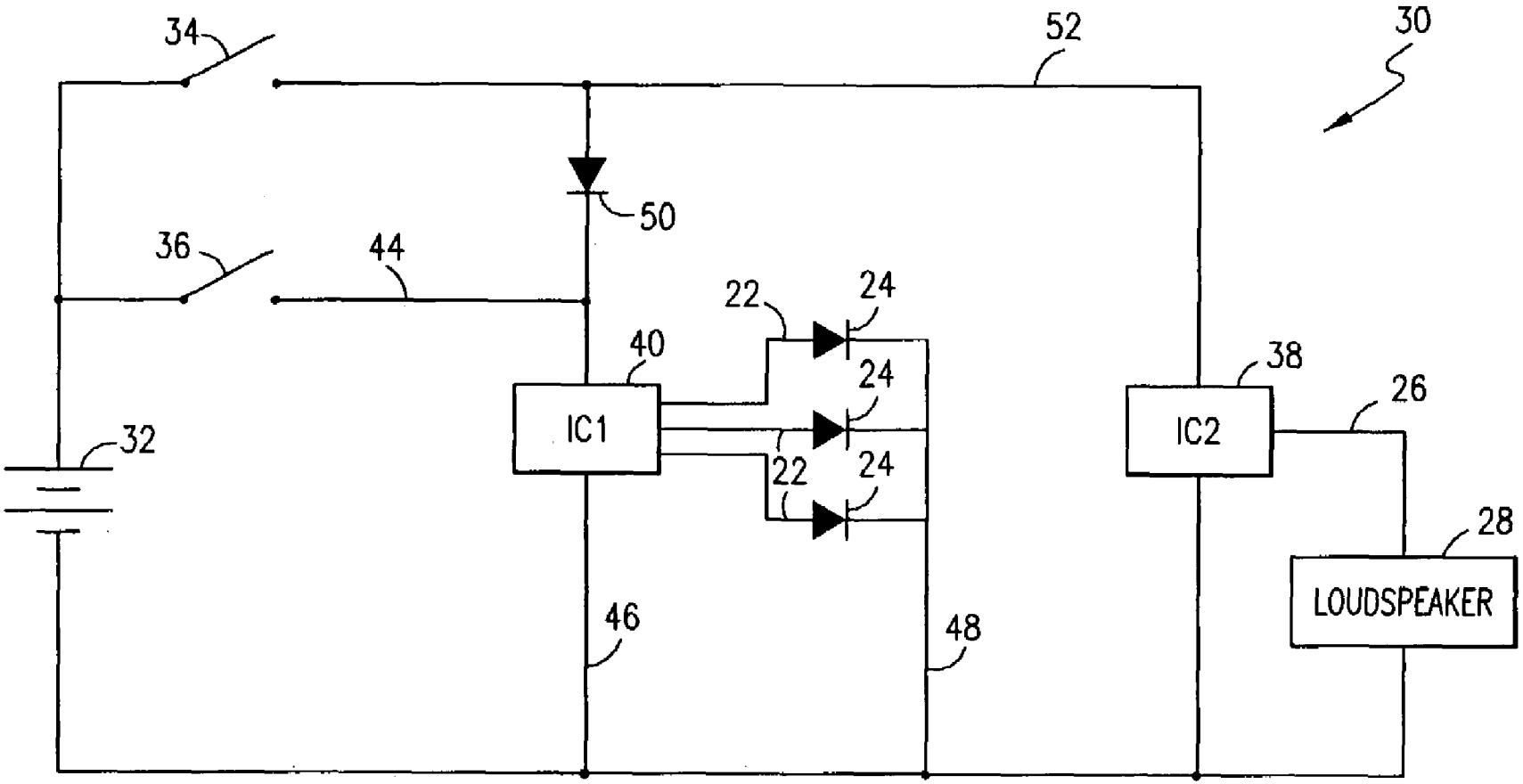
FIG. 2 is a schematic circuit diagram of one embodiment of the electrical circuit of this invention including the LEDs and loudspeaker shown in FIG. 1.

With reference to FIGS. 1 and 2, an electrical circuit 30 is schematically depicted which includes a battery 32, a reed switch 34, a spring switch 36, a sound integrated circuit (IC) 38 (IC 1), a lighting integrated circuit 40 (IC 2) and the LEDs 24 and loudspeaker 28. The battery 32, ICs 38, 40 and spring switch 36 are preferably mounted on the module 18, with the wire 26 connecting the sound IC 38 to the loudspeaker 28 and the wires 22 connecting the lighting IC 40 to the LEDs 24. The reed switch 34 may be carried by to the module 18, or, alternatively, it may be mounted within a separate casing 42 as described below in connection with a discussion of FIGS. 3A and 3B.

In one presently preferred embodiment, the spring switch 36 is connected by a line 44 to the lighting IC 40, which, in turn, is connected by line 46 to the opposite terminal of the battery 32. As noted above, wires 22 connect the lighting IC 40 with the LEDs 24 and they are connected via line 48 to the battery 32. The reed switch 34 is connected through a diode 50 to the lighting IC 40, and by line 52 to the sound IC 38. Both the sound IC 38 and loudspeaker 28 are connected to the battery 32, as schematically shown in FIG. 2.

The detailed construction of the spring switch 36, sound IC 38 and lighting IC 40 forms no part of this invention and is therefore not discussed herein. Each of these elements is known in the art and commercially available. One type of spring switch 36 suitable for use in the module 18 is disclosed in U.S. Pat. No. 5,408,764. The sound IC 38 is available under part number 66391, and the lighting IC 40 is available under part number 6608, both from Cheerine Development (Hong Kong) Ltd., having a place of business at Room 1217, North Tower, Concordia Plaza, No. 1 Science Museum Road, Tsim Sha Tsui East, Kowloon, Hong Kong. Depending upon the particular sound IC 38 selected, a sound is produced by the loudspeaker 28 such as a race car, a song etc. The lighting IC 40 is effective to illuminate the LEDs 24 in one or more flashing or other lighting sequence of predetermined duration.

Figure 3A:
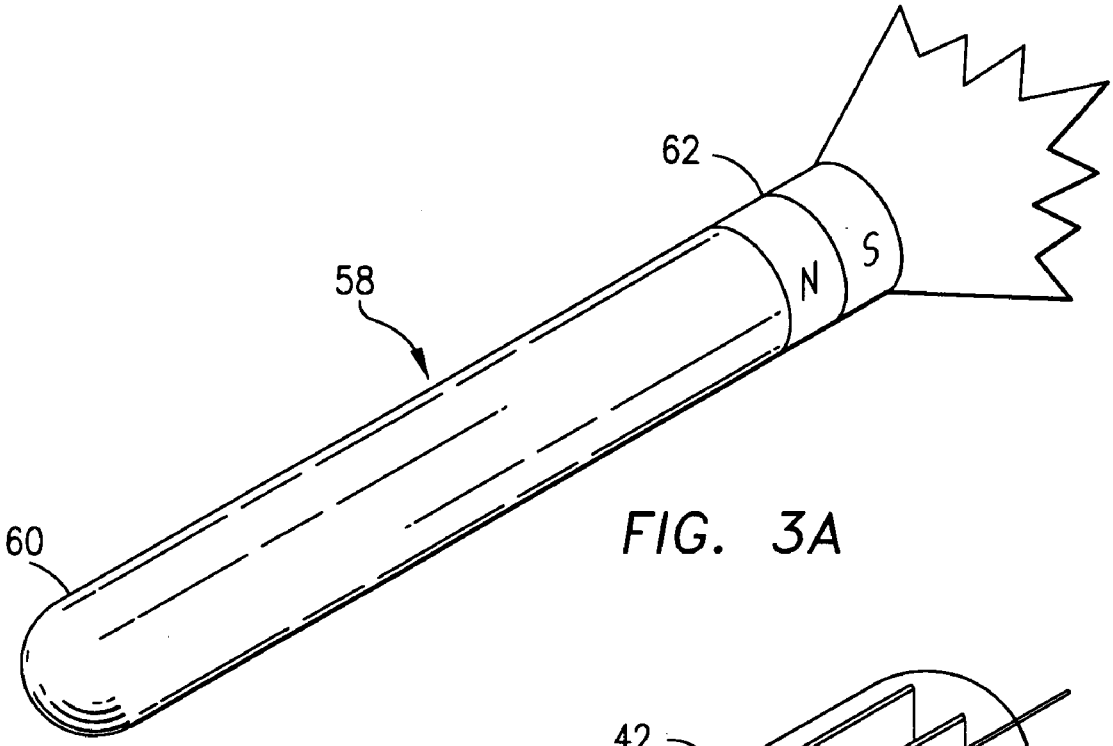
FIG. 3A is a perspective view of a wand which mounts a permanent magnet.
Figure 3B:
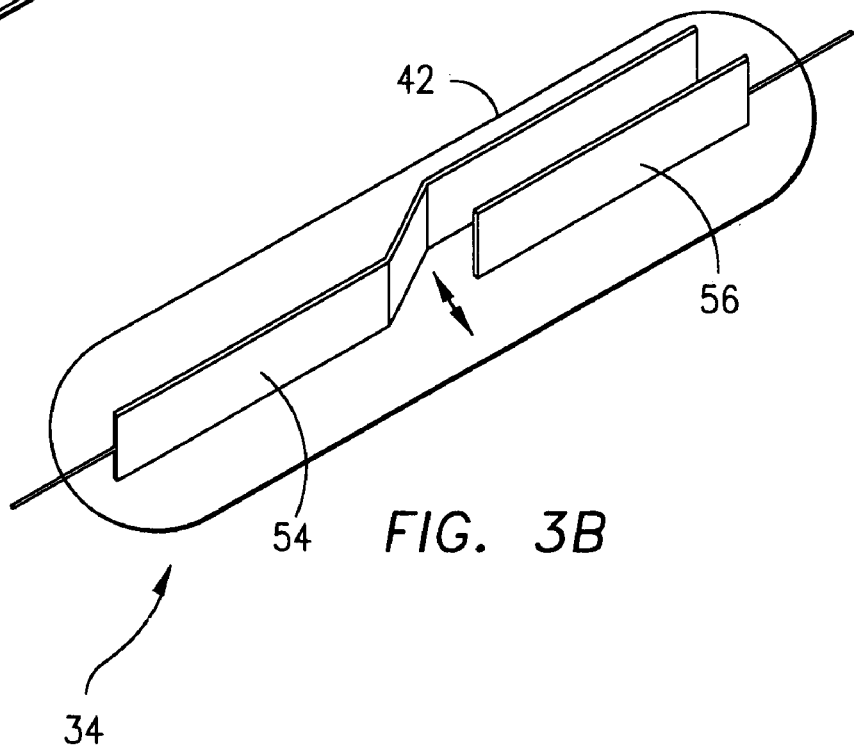
FIG. 3B is a schematic view of a reed switch which is closed by the permanent magnet depicted in FIG. 3A.

The reed switch 34 is of conventional construction as shown in FIG. 3B. It includes a first contact 54 and a second contact 56 which are spaced from one another within casing 42. Each of the contacts 54 and 56 is formed of a metal which is movable under the influence of a magnetic field. For purposes of illustration, a wand 58 is depicted in FIG. 3A having a handle 60 which mounts a permanent magnet 62 at one end. Essentially any other kind of toy or other holder could be employed to mount the permanent magnet 62, and the wand 58 is shown for purposes of illustration only.

The electrical circuit of this invention operates as follows. As shown in FIG. 2, the spring switch 36 is connected between one terminal of the battery 32 and the lighting IC 40, which, in turn, connects to the other battery terminal. In response to the application of an inertial force or motion to the spring switch 36, it operates to electrically connect the battery 32 with the lighting IC 40. This activates the lighting IC 40 which is effective to illuminate the LEDs 24 connected thereto in a particular flashing or other lighting sequence.

The reed switch 34 employed in the shoe 10 of this invention is not operated in response to the application of pressure, an inertial force, motion or the like. Instead, the contacts 54 and 56 of the reed switch 34 are movable into engagement with one another in response to the application of a magnetic field. This magnetic field is provided by the permanent magnet 62 carried at the end of wand 58. The wand 58 is grasped by its handle 60 and placed at a location on the outside of the shoe 10 in proximity to where the reed switch 34 is mounted. The wand 58 and magnet 62 are then moved relative to the shoe 10 and the reed switch 34 so that the magnetic field of the magnet 62 causes the contacts 54, 56 of the reed switch 34 to engage one another. This electrically connects the battery 32 with the sound IC 38, and also with the lighting IC 40 through the diode 50 as shown in FIG. 2. The sound IC 38 sends a signal to the loudspeaker 28 causing it to produce a particular sound, and the lighting IC 40 operates in the same manner describe above to illuminate the LEDs 24. Both the sound IC 38 and lighting IC 40 are operative to turn off the loudspeaker 28 and LEDs 24, respectively, after a predetermined period at which time they reset in preparation for another sequence of operation.

In the embodiment of this invention shown in FIG. 2, closure of the spring switch 36 is effective to operate only the lighting IC 40. The diode 50 does not conduct when connected to the battery 32 through the spring switch 36. Consequently, when a child is walking, running or otherwise applying motion or an inertial force on the shoe 10 and spring switch 36, only the LEDs 24 are illuminated and no sound is produced. Upon placement of the permanent magnet 62 into proximity with the reed switch 34, as discussed above, closure of the reed switch 34 results in the activation of both the sound IC 38 and lighting IC 40 since the diode 50 conducts when connected to the battery 32 through reed switch 34. The LEDs 24 and loudspeaker 28 are therefore operated at the same time by the magnet 62, and the loudspeaker 28 is operated only in response to closure of the reed switch 34.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in the embodiment of this invention shown in the Figs., a spring switch 36 is connected between the battery 32 and lighting IC 40 so that the LEDs may be illuminated in response to the application of an inertial force or motion to the shoe 10 and independently of the operation of the reed switch 34. In an alternative embodiment, the spring switch 36 is eliminated so that the lighting IC 40 is activated in response to operation of the reed switch 34. In that case, the LEDs 24 and loudspeaker 28 are always activated at the same time, independently of any motion or inertial force applied to the shoe 10.

Additionally, for purposes of the present discussion, operation of the lighting IC 40 and sound IC 38 have been described as being responsive to movement of the reed switch 34 or spring switch 36 from an open position to a closed position. It should be understood that in some designs integrated circuits illuminate LEDs in a particular lighting sequence in response to movement of a switch from the closed position to the open position. See, for example, U.S. Pat. No. 5,903,103. Consequently, reference in the foregoing description and in the appended claims to activation of the sound IC 38 and/or lighting IC 40, or a "signal device," e.g., LEDs 24 or speaker 28, in response to "closing" of switch 34 or 36, is meant to broadly encompass integrated circuit operation which is responsive to movement of the switch from the open position to the closed position or from the closed position to the open position.

Therefore, it is intended that the invention not be limited to the particular embodiment disclosed as the best mode contemplated for carrying out this invention, but that the invention will include all embodiments falling within the scope of the appended claims.

I claim:

1. An article of footwear, comprising:

an outsole, and an upper mounted to said outsole;

an electrical circuit mounted to at least one of said outsole and said upper, said electrical circuit including:

(i) a battery;

(ii) at least one LED;

(iii) at least one loudspeaker;

(iv) a lighting integrated circuit and a sound integrated circuit, said lighting integrated circuit being coupled to said at least one LED and said sound integrated circuit being coupled to said at least one loudspeaker;

(v) a first switch coupled to said battery, to said sound integrated circuit and to said lighting integrated circuit, said first switch being movable under the influence of a magnetic field from an open position to a closed position;

(vi) an inertia switch coupled to said battery and to said lighting integrated circuit, said inertia switch being operative independently of said first switch in response to the application of inertia or motion thereto to cause said lighting integrated circuit to illuminate said at least one LED;

a magnet located externally of said outsole and said upper, said magnet being movable into sufficient proximity with said first switch so that the magnetic field of said magnet moves said first switch to said closed position independently of said inertia switch, at least one of said lighting integrated circuit and said sound integrated being activated by said first switch to cause said at least one LED to illuminate and said at least one loudspeaker to produce a sound, respectively.

2. The article of footwear of claim 1 in which said magnet is a permanent magnet mounted to a toy.

3. The article of footwear of claim 1 in which at least a portion of said electrical circuit is housed by a module mounted to said outsole, said at least one LED and said at least one loudspeaker being mounted to said upper.

4. The article of footwear of claim 1 in which said first switch is a reed switch.

5. The article of footwear of claim 1 in which said inertia switch is a spring switch.

6. Apparatus for use with an article of clothing, comprising:

a module adapted to be mounted to an article of clothing;

an electrical circuit at least partially carried by said module, said electrical circuit including:

(i) a battery;

(ii) at least one LED;

(iii) at least one loudspeaker;

(iv) a lighting integrated circuit and a sound integrated circuit, said lighting integrated circuit being coupled to said at least one LED and said sound integrated circuit being coupled to said at least one loudspeaker;

(v) a first switch coupled to said battery, to said sound integrated circuit and to said lighting integrated circuit, said first switch being movable under the influence of a magnetic field from an open position to a closed position;

(vi) an inertia switch coupled to said battery and to said lighting integrated circuit, said inertia switch being operative independently of said first switch in response to the application of inertia or motion thereto to cause said lighting integrated circuit to illuminate said at least one LED;

a magnet located externally of said article of clothing, said magnet being movable into sufficient proximity with said first switch so that the magnetic field of said magnet moves said first switch to said closed position independently of said inertia switch, at least one of said lighting integrated circuit and said sound integrated being activated by said first switch to cause said at least one LED to illuminate and said at least one loudspeaker to produce a sound, respectively.

7. The apparatus of claim 6 in which said magnet is a permanent magnet mounted to a toy.

8. The apparatus of claim 6 in which said first switch is a reed switch.

9. The apparatus of claim 6 in which said inertia switch is a spring switch.

10. The apparatus of claim 6 in which said magnet is a permanent magnet mounted to a toy.

* * * * *